United States Patent [19]

Heard

[11] Patent Number: 4,801,115

[45] Date of Patent: Jan. 31, 1989

[54] MOUNTING FOR OFFSET SIGN

[75] Inventor: Robert A. H. Heard, Bristol, England

[73] Assignee: Signfix Limited, Bristol, England

[21] Appl. No.: 884,508

[22] Filed: Jul. 11, 1986

[30] Foreign Application Priority Data

Jul. 19, 1985 [GB] United Kingdom ..... 8518251

[51] Int. Cl.[4] ..... G09F 17/00

[52] U.S. Cl. ..... 248/219.3; 248/219.4; 248/231; 40/607

[58] Field of Search ..... 248/219.4, 219.1, 219.3, 248/218.4, 74.1, 230, 231; 40/606, 607, 612; 52/710, 709

[56] References Cited

U.S. PATENT DOCUMENTS

| | | | |
|---|---|---|---|
| 3,341,959 | 9/1967 | Sabadies | 40/607 |
| 4,101,191 | 7/1978 | Gould et al. | 248/219.3 X |
| 4,125,240 | 11/1978 | Heard | 248/218.4 |
| 4,595,165 | 6/1986 | Klingensmith et al. | 248/230 X |
| 4,705,253 | 11/1987 | Heard | 248/219.4 |
| 4,730,803 | 3/1988 | Hillstrom | 248/219.4 X |

FOREIGN PATENT DOCUMENTS

| | | | |
|---|---|---|---|
| 2394135 | 2/1979 | France | 248/218.4 |
| 1416734 | 12/1975 | United Kingdom | 248/231 |
| 1511145 | 5/1978 | United Kingdom | 248/231 |
| 2021390 | 12/1979 | United Kingdom | 248/219.1 |

*Primary Examiner*—Ramon S. Britts
*Assistant Examiner*—Karen J. Chotkowski
*Attorney, Agent, or Firm*—William R. Hinds

[57] ABSTRACT

A mounting bracket for mounting an offset sign (46) to a post (50) has a plate (12) for rivetting to a T-shaped reinforcing element (44) along the top or bottom of the sign. The bracket has two transverse channels (14,28). One channel (14) has internal ribs (23,24) defining a slot (27) to receive the head (34) of a bolt (32), the shank (33) of which then projects from the channel for bolting it to the post (50). An alternative method of mounting is to pass a strap around the post and through the channel (28). The bracket can accommodate round posts by cutting a shallow V profile (58) in the walls at the mouth of the channel (14).

10 Claims, 4 Drawing Sheets

MOUNTING FOR OFFSET SIGN

This invention relates to mountings for offset signs.

Various mountings for offset signs have been previously proposed by the present inventor, in for example G.B. Pat. Nos. 1572161, 2021390, EP No. 19432 and U.S. application Ser. No. 739194 filed May 30, 1985 now U.S. Pat. No. 4,705,253. A common feature of these devices is that they comprise two elements; a first element which is adapted for securing to a supporting post, and a second element in the form of a flat plate which extends in a horizontal plane at right angles to the plane of the sign and is secured to the sign plate via a T-shaped reinforcing member extending along the edge of the sign plate. There is a problem associated with the mounting portion of the device, in that sign posts come in varying sizes and cross-sectional shapes, and also the methods for securing to a post can be rather varied. For example, in some cases a sign is secured to a post by means of bolts passed through the post and retained by nuts on the far side of the post. In other cases the sign may be secured to the post by means of high tensile banding passed around the post and tightened and secured by means of a a buckle. In yet other cases, specially designed mounting clips may be used, for example of stainless steel sheet. In order to accommodate these various possibilities, it has previously been thought necessary to provide a variety of different mounting brackets. However, this requires the sign maker and installer to select the appropriate bracket, which may not in the end suit the post on site. Since it is convenient to fix the bracket to the sign plate before going out on site, this can be inconvenient and wasteful. Also, it is inconvenient and expensive to have to stock different types of mounting brackets.

In an attempt to ameliorate this problem the present invention seeks to provide a mounting bracket for an offset sign, which is of wider application.

The present invention provides an offset sign comprising a supporting post and a sign plate mounted to the supporting post by a pair of multifunctional mounting brackets top and bottom respectively of the sign plate, in which each bracket can be used in different functional modes for mounting the bracket to the supporting post; each bracket having a horizontal plate extending along an edge of the sign plate and secured thereto, and having a pair of transverse channels at the post end of the sign plate, the pair of transverse channels comprising first and second channels each comprising a pair of opposite walls joined by a third wall, the third wall of each channel being provided by a common web separating the channels, the first channel having a mouth opening toward the post and a pair of mutually inwardly directed ribs on the opposite walls extending lengthwise of the first channel, the second channel being on the side of the first channel remote from the post, the channels providing alternative modes of mounting the bracket to the post, each bracket being mounted to the post by a selected one of the alternative modes. One mode of mounting comprises a bolt having a screw-threaded shank projecting from the mouth of the first channel through an aperture in the post, a first member at one end of the shank slidably engaged in the first channel behind the ribs and prevented by the channel wall from rotating, and a second member on the other end of the shank on the opposite side of the post. Another mode of mounting comprises a strap passed and tightened around the post and through the second channel of the bracket. A third mode of mounting comprises a strap passed and tightened around the post, the strap being provided with attachment members which engage in the first channel of the bracket and are retained by mutually inturned lips at the mouth of the first channel.

Conveniently the bracket is extruded from metal such as aluminium in a direction lengthwise of the channel.

In order that the invention may be more clearly understood, the bracket in its various modes of use will now be described with reference to the accompanying drawings, wherein.

Figure 1:
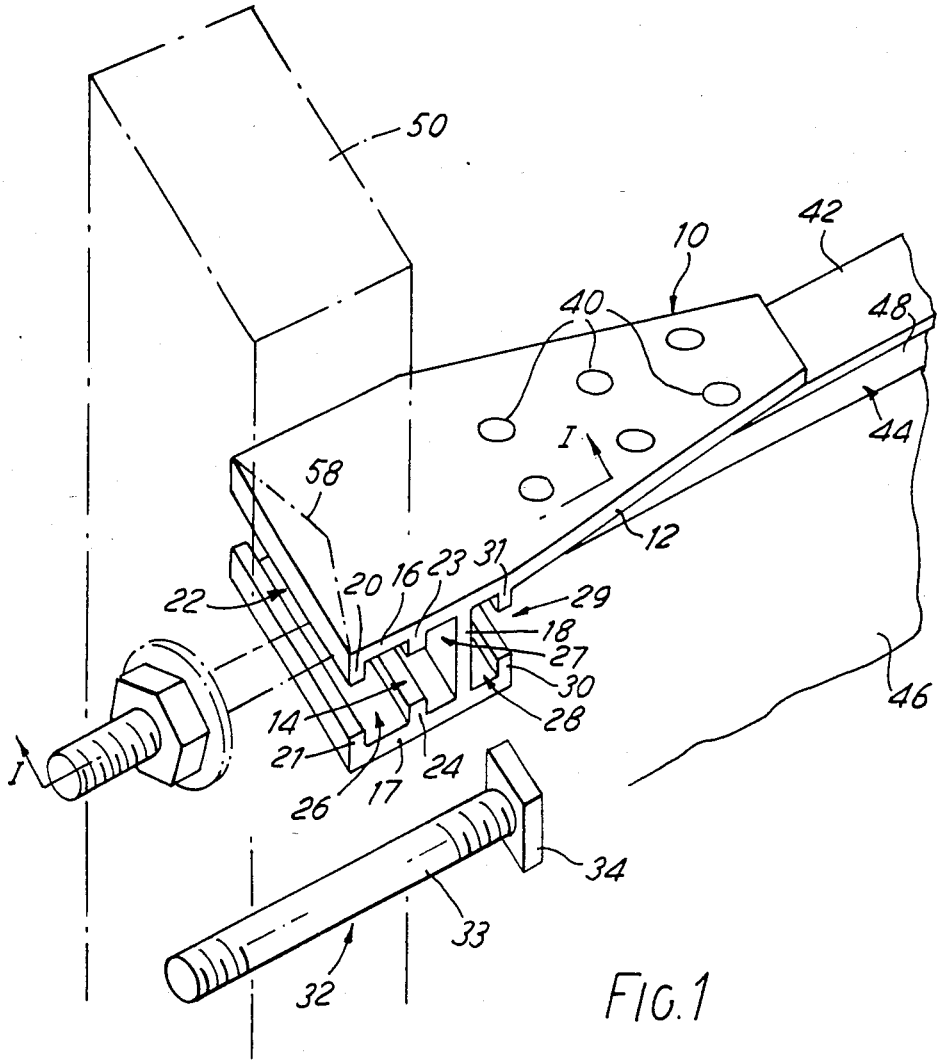
FIG. 1 shows a perspective view of the bracket in a first mode of use.
Figure 2:
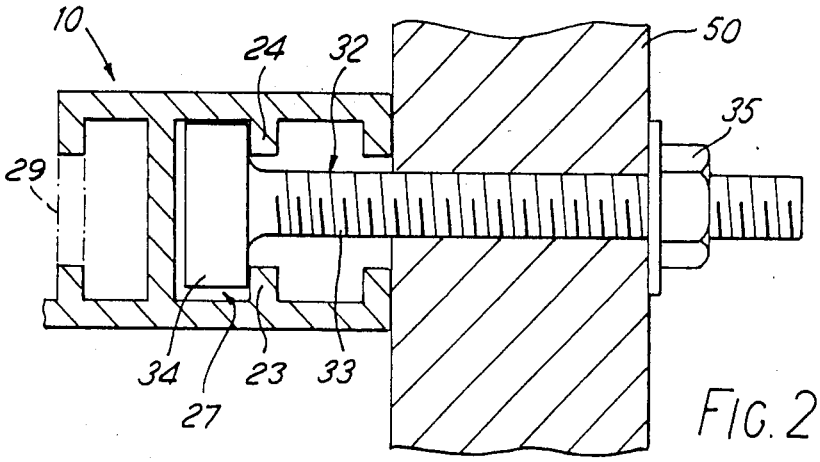
FIG. 2 shows a cross-sectional view along the line I-I of FIG. 1, when the bolt occupies the position indicated in dot-dash lines.
Figure 3:
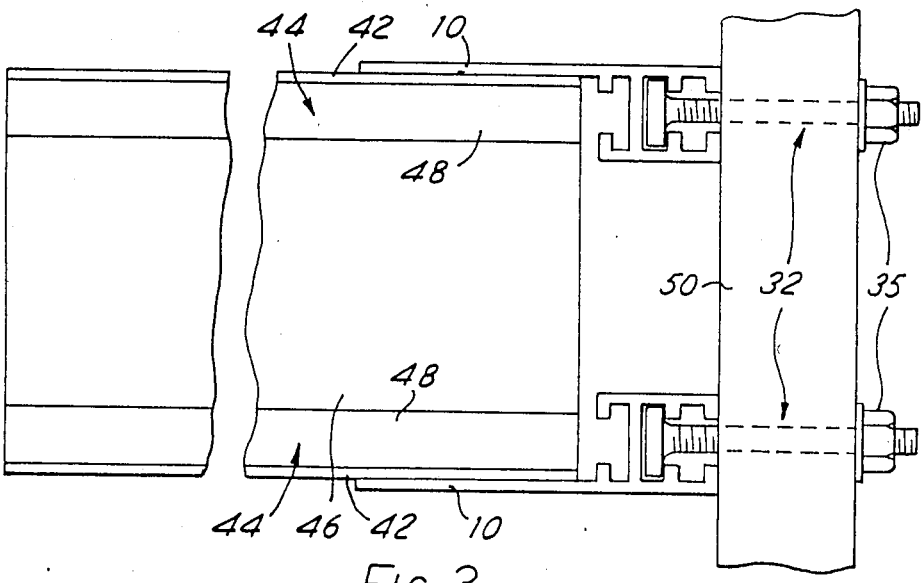
FIG. 3 shows a side view of a sign supported by a pair of brackets as in FIGS. 1 and 2.

Referring to the drawings and firstly to FIGS. 1 to 3; the bracket 10 comprises an elongate plate 12 having a first channel 14 disposed to one side of the plane of the plate. The channel is defined by parallel walls 16,17 joined by a web 18, and has two mutually inturned lips 20,21 restricting the mouth 22 of the channel. Two internal ribs 23,24 project from the walls 16,17 and extend lengthwise of the channel, thereby dividing the channel into mouth and base regions 26,27 respectively, the base region being narrower than the mouth region. The channel 14 opens in the direction remote from the direction of elongation of the plate 12. On the other side of the web 18 there is provided a second channel 28 having a mouth 29 opening in the same direction as the direction of elongation of the plate 12. The mouth of the channel 28 is restricted by mutually inturned lips 30,31, or the mouth may be omitted, as indicated at 29 in FIG. 2, to provide an open-ended box-section.

The bracket is extruded from aluminium in the direction lengthwise of the channels, the extrusion being cut into suitable lengths equal to the length of the channel. For aesthetic reasons, the side edges of the plate are also trimmed so that the plate tapers in the direction of the sign plate. The plate is drilled to take rivets 40 or the like which secure the plate to the top web 42 of a T-shaped reinforcing member 44 which extends lengthwise of the sign plate 46, the leg 48 of the T being secured to the face of the sign plate. Reinforcing members 44 and brackets 10 are provided at the top and bottom of the sign plate 46, as indicated in FIG. 3.

In the first mode of use shown in FIGS. 1 to 3, the sign is being attached to a supporting post 50 by means of bolts 32, whose threaded shanks 33 pass through apertures in the post and are secured by nuts 35 on the far side of the post. Each bolt has a square head 34 which is retained within the base region 27 of the channel 14 of a respective one of the brackets 10. The ribs 23,24 retain the head of the bolt within this region, and provide a counter-abutment for the tension applied by the nut 35. The head of the bolt can be introduced into the end of the base region of the channel and slid along until the shank 33 projects from the centre of the mouth 22, as indicated in FIG. 1.

Figure 4:
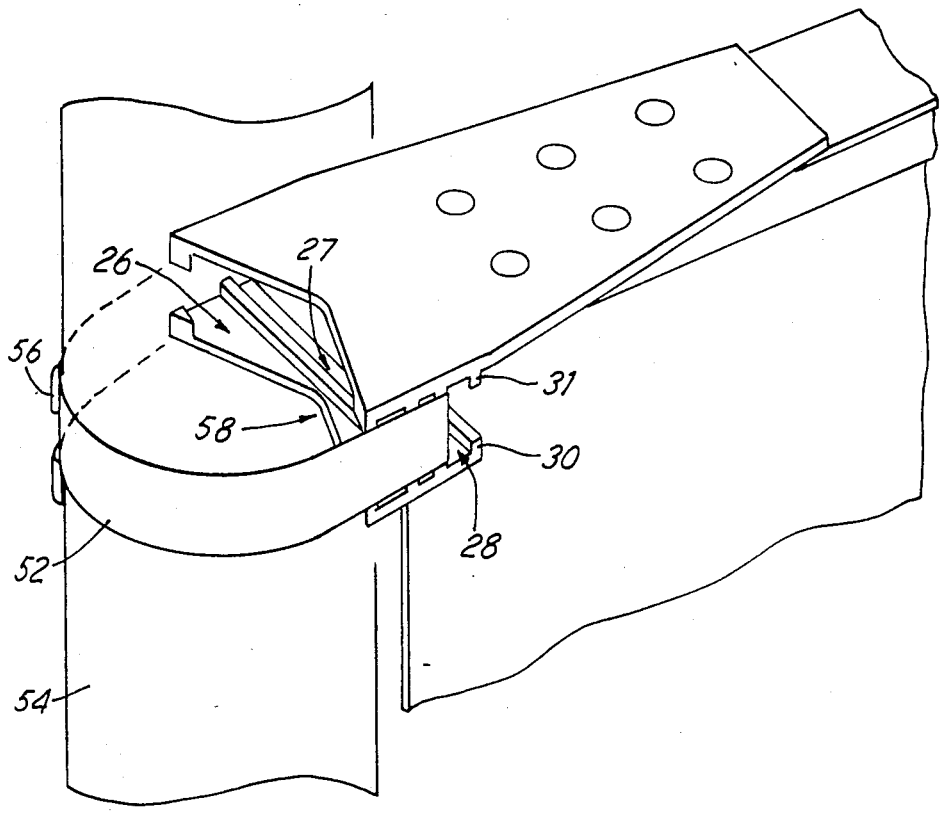
FIG. 4 shows a perspective view of the bracket in a second mode of use.

Referring now to FIG. 4; in this case, a strap 52 of steel or other high tensile material is used to secure the bracket to the post 54. The strap is passed through the channel 28 and around the post, tightened and secured by a buckle 56 in conventional manner. The strap is prevented from slipping off the bracket by virtue of the side walls of the channel 28, and the lips 30,31 also enable the strap to be retained in the channel during the fixing process.

In the embodiment shown in FIG. 4, the post 54 is shown as having a circular cross-section. It is possible to use the brackets 10 in unmodified form in conjunction with circular posts, but it is preferred to cut a shallow V-section 58 out of the mouth region 26 of the channel, to provide a double region of contact with the post, rather than the single region which will be provided by the straight edged channel shown in FIG. 1. Since the cut-out 58 does not extend into the base region 27 of the channel, it will be apparent that brackets having this type of cut-out can likewise by used with circular posts in conjunction with the bolt fixing arrangement of FIGS. 1 to 3.

Figure 5:
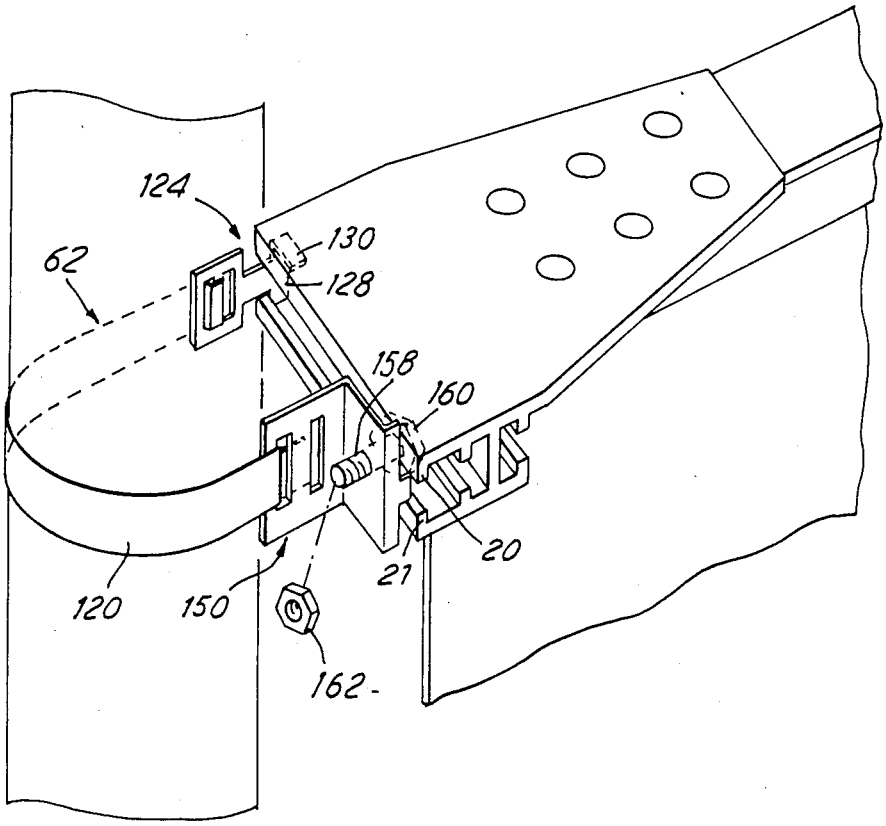
FIG. 5 shows a perspective view of the bracket in a third mode of use.

Referring now to FIG. 5; this shows the bracket 10 being secured to a post by means of a stainless steel mounting clip 62 of the kind shown in G.B. Pat. No. 1416734. A stainless steel strap 120 carries attachment members 124,150 at its ends. The attachment member 124 has a toggle end 128 with ears 130 projecting in opposite directions so as to engage under the lips 20,21 of the channel 14. The attachment member 150 is secured in the channel by means of a bolt whose head 160 is retained by the lips 20,21 with its shank 158 projecting from the channel mouth through an aperture in the attachment member 150, and secured by means of a nut 162, which also serves to tighten the strap around the post.

The mouth region 26 of the channel 14 can also be used with other attachment devices of the present inventor, such as those described in G.B. Pat. Nos. 1461111, 1598806, 1567172, and 1547359.

It will be apparent that the mounting bracket of the present invention can be used in a variety of modes, with different sizes and cross-sectional shape of post, with the sign-maker and installer only having to stock one type of bracket.

I claim:

1. A multifunctional bracket for an offset sign, in which the bracket can be used in different functional modes for mounting the sign to a supporting post, the bracket comprising first and second channels each comprising a pair of opposite walls joined by a third wall, said third wall of each channel being provided by a common web separating the channels, said first channel having a mouth restricted by inturned lips, whereby attachment members on a strap passed around a supporting post may be retained in a first functional mounting mode, and a pair of internal mutually opposed ribs on said opposite walls extending lengthwise of the channel and dividing the channel into inner and mouth regions, whereby the head of a bolt mounting the bracket to a supporting post may be retained in the inner region in a second functional mounting mode, said second channel providing a location for a strap passed around a supporting post and the bracket in a third functional mounting mode, the bracket further comprising a plate extending from a wall of said second channel in the direction remote from the first channel for attachment thereto of a sign plate.

2. A bracket according to claim 1, wherein at the ends of said first channel the ribs lie closer to said third wall than the mouth of the channel.

3. A bracket according to claim 1, wherein said second channel has a mouth opening in the opposite direction from that of the first channel.

4. A bracket according to claim 3, wherein the mouth of the second channel is restricted by inturned lips.

5. A bracket according to claim 1, wherein the second channel is of open-ended box-section.

6. A bracket according to claim 1 wherein the bracket is extruded from metal in a direction lengthwise of the channel.

7. An offset sign comprising a supporting post and a sign plate mounted to said supporting post by a pair of multifunctional mounting brackets top and bottom respectively of the sign plate, in which each bracket can be used in different functional modes for mounting the bracket ot the supporting post; each bracket having a horizontal plate extending along an edge of the sign plate and secured thereto, and having a pair of transverse channels at the post end of the sign plate, said pair of transverse channels comprising first and second channels each comprising a pair of opposite walls joined by a third wall, said third wall of each channel being provided by a common web separating said channels, said first channel having a mouth opening towards the post and a pair of mutually inwardly directed ribs on said opposite walls extending lengthwise of the channel, said second channel being on the side of the first channel remote from the post, said channels providing alternative modes of mounting the bracket to the post, each bracket being mounted to the post by a selected one of said modes which comprises a bolt having a screw-threaded shank projecting from the mouth of the first channel through an aperture in the post, a first member at one end of the shank slidably engaged in said first channel behind said ribs and prevented by said channel walls from rotating, and a second member on the other end of the shank on the opposite side of the post.

8. An offset sign comprising a supporting post and a sign plate mounted to said supporting post by a pair of mounting brackets top and bottom respectively of the sign plate, in which each bracket can be used in different functional modes for mounting the bracket to the supporting post; each bracket having a horizontal plate extending along an edge of the sign plate and secured thereto, and having a pair of transverse channels at the post end of the sign plate, said pair of transverse channels comprising first and second channels each comprising a pair of opposite walls joined by a third wall, said third wall of each channel being provided by a common web separating said channels, said first channel having a mouth opening towards the post, and having a pair of mutually inwardly directed ribs on said opposite walls extending lengthwise of the channel, said second channel being on the side of the first channel remote from the post, said channels providing alternative modes of mounting the bracket to the post, each bracket being mounted to the post by a selected one of said modes which comprises a strap passed and tightened around the post and through said second channel of the bracket.

9. An offset sign according to claim 8, wherein the post is of circular cross-section and the edges of said first channel at the channel mouth are provided with a shallow V-profile in plan.

10. An offset sign comprising a supporting post and a sign plate mounted to said supporting post by a pair of mounting brackets top and bottom respectively of the sign plate, in which each bracket can be used in different functional modes for mounting the bracket to the supporting post; each bracket having a horizontal plate extending along an edge of the sign plate and secured thereto, and having a pair of transverse channels at the post end of the sign plate, said pair of transverse channels comprising first and second channels each comprising a pair of opposite walls joined by a third wall, said third wall of each channel being provided by a common web separating said channels, said first channel having a mouth opening towards the post, and having a pair of mutually inwardly directed ribs on said opposite walls extending lengthwise of the channel, said second channel being on the side of the first channel remote from the post, said channels providing alternative modes of mounting the bracket to the post, each bracket being mounted to the post by a selected one of said modes which comprises a strap passed and tightened around the post, the strap being provided with attachment members which engage in the first channel of the bracket and are retained by mutually inturned lips at the mouth of the channel.

* * * * *